US006374785B1

(12) United States Patent
Schäfer et al.

(10) Patent No.: US 6,374,785 B1
(45) Date of Patent: Apr. 23, 2002

(54) ARRANGEMENT FOR ROTARY ANGLE POSITIONING OF A CAMSHAFT RELATIVE TO THE CRANK SHAFT OF AN INTERNAL COMBUSTION ENGINE

(75) Inventors: Jens Schäfer; Martin Steigerwald, both of Herzogenaurach; Matthias Kapp, Hemhofen, all of (DE)

(73) Assignee: Ina Walzlager Schaeffler OHG, Herzogenaurach (DE)

( * ) Notice: Subject to any disclaimer, the term of this patent is extended or adjusted under 35 U.S.C. 154(b) by 0 days.

(21) Appl. No.: 09/612,803

(22) Filed: Jul. 10, 2000

(30) Foreign Application Priority Data

Jul. 10, 1999 (DE) ..... 199 32 299

(51) Int. Cl.[7] ..... F01L 1/34

(52) U.S. Cl. ..... 123/90.15; 123/90.12; 123/90.16; 123/90.17

(58) Field of Search ..... 123/90.15, 90.17, 123/90.31, 90.37; 74/568 R; 464/1, 2, 160; 92/124

(56) References Cited

U.S. PATENT DOCUMENTS 5,809,955 A * 9/1998 Murata ..... 123/90.17
5,813,378 A * 9/1998 Sato ..... 123/90.17

FOREIGN PATENT DOCUMENTS

JP 10089021 A 4/1998

* cited by examiner

*Primary Examiner*—Thomas Denion
*Assistant Examiner*—Jaime Corrigan
(74) *Attorney, Agent, or Firm*—Volpe and Koenig, P.C.

(57) ABSTRACT

This invention pertains to a vane-cell positioning device with an external rotor (1) driven by the crankshaft of an internal combustion engine and an internal rotor (2) fixed to and turning with a camshaft which has pivoting vanes (15) that fit inside vane mounting notches (16), said vanes being loaded with pressurized oil in hydraulic work spaces (31) of the external rotor (1).

The danger of the pivoting vanes (15) lifting off of the radial sealing surfaces is eliminated by loading the bottoms of the pivoting vanes (15) with pressurized oil as the internal combustion engine is running.

13 Claims, 2 Drawing Sheets

ARRANGEMENT FOR ROTARY ANGLE POSITIONING OF A CAMSHAFT RELATIVE TO THE CRANK SHAFT OF AN INTERNAL COMBUSTION ENGINE

BACKGROUND OF THE INVENTION

The invention pertains to a device to adjust the rotary angle position of a camshaft relative to the crankshaft of an internal combustion engine according to the features the preamble of claim 1, and it is particularly advantageous for so-called vane-cell positioning devices.

A device of this type is already known from EP 0 818 610 A2. In this reference, there are five hydraulic working chambers inside an external rotor that are each subdivided into two pressure chambers by means of pivoting vanes. Between the bottom of the pivoting vanes and the base of the notch that receives the vane, there is a gap for vane pressure springs. The width and depth of this gap is determined by distance elements fastened at the bottom. The vane pressure springs effect a radial seating of the pivoting vanes against a cylindrical interior side of the working chambers. This is intended to effect a radial seal between the pressure chambers, which is required for a high functional reliability, efficiency and positioning speed of the vane-cell positioning device.

In DE 197 15 570 A1, a vane-cell positioning device is described with three hydraulic working chambers in the external rotor and with three pivoting vanes of the inner rotor. The pivoting vanes divide each of the working spaces into two pressure chambers. The radial seal between two pressure chambers is strived for by means of the thickness (=sealing length) of the pivoting vane and its centrifugal force, and the axial seal is strived for by means of spring-loaded sealing strips at the sides of the pivoting vane.

In EP 0 807 746 A1, a rotating vane positioning device is described in which an external rotor is provided with four hydraulic working chambers that are each divided by a vane from an internal rotor into two pressure chambers. The working chambers have a cylindrical internal contour and radial separating walls that extend to a hub of the internal rotor. Spring-loaded sealing strips serve as radial seals between the separating walls and the hub as well as between the vanes and the cylindrical internal contour. These sealing strips are intended to minimize the leakage between the pressure chambers.

Common to all three solutions is that the sealing elements are pushed by spring and/or centrifugal force against the sealing surfaces. Because of this, the danger exists that the sealing elements are lifted off of their sealing surfaces by the oil pressure in the pressure chambers, thus losing their sealing effect. This lowers the functional reliability, the effectiveness and the positioning speed of the device.

SUMMARY OF THE INVENTION

The object of this invention is to ensure the seating of the pivoting vanes against the interior perimeter of the external rotor in a device to adjust the rotary angle position of a camshaft with respect to a crankshaft of an internal combustion engine, in particular for a vane-cell positioning device according to the preamble of claim 1, within its entire rotational range.

According to the invention, this object is met by loading the bottoms of the pivoting vanes with oil pressure when the internal combustion engine is running. In this way, the pivoting vanes are hydraulically pressed against the interior perimeter of the external rotor. Since the pivoting vanes are also still forced outward by centrifugal force, depending on the rpm, the vane pressure springs can be eliminated, if necessary. Without vane pressure springs, the assembly of the vane-cell positioner becomes significantly simpler. Also, the influence of the contact pressure of the vane pressure springs on the function, and thus reliability of the vane-cell positioning device, is eliminated or reduced. The vane pressure springs are commonly just flat bent springs manufactured from flat spring band. The hydraulic loading of the bottoms of the pivoting vanes requires no additional space to work with.

It is advantageous to have the bottoms of the pivoting vanes in fluid communication with the pressure chambers or with their supply lines, in particular with annular spaces located in the interior of the rotor. In this way, the oil pressure in existence at the bottom of the pivoting vanes always matches that in the pressure chambers. This means that the higher the oil pressure in the pressure chambers and thus the tendency to lift off the pivoting vane, the larger is the pressing force and thus the seal between the pressure chambers. The result of a better internal oil seal is, mainly in the regulated position of the vane-cell positioning device, that less oil needs to be fed into the pressure chambers, which means an increase in the effectiveness and the positioning speed of the vane-cell positioning device.

It has been shown to be advantageous that the two working surfaces of the pivoting vane have preferably centered radial feed notches on them. Oil pressure passes through the feed notches from the pressure chambers into the gap and thus to the bottom of the pivoting vane. Since the oil pressure feed must occur from both pressure chambers, and thus a feed notch is required at both working surfaces of the pivoting vane, these are at the same time a leakage source. Therefore, their dimensions constitute a compromise between undesired throttling of the oil feed to the bottom of the pivoting vane and thus a delayed pressure build-up in the gap, and a desired throttling of flow to the other pressure chamber. The compromise solution is made easier in that the leakage flow into the neighboring pressure chamber is throttled twice as much as the fill flow into the gap.

In order to optimize this compromise, it is advantageous that in the installed position of the pivoting vanes, the feed notches extend from their bottoms to at least the area below the upper edges of the vane mounting notches. The required throttling can be attained by selecting the cross section of feed notches extending along the entire length of the pivoting vanes or by selecting the overhang between the vane mounting notch and the feed notches of the installed pivoting vanes extending up to just in front of their upper edges.

An advantageous development of the invention is that in a hub of the internal rotor and each vane mounting notch, an axial hole is provided that connects the two annular spaces to one another and intersects a radial hole that runs through the middle of each notch base. An axially shifting piston sealing slides inside the axial holes, which controls the radial holes and whose stroke is bounded on both sides by axial stops. In this way, the bottom of the pivoting vane is supplied with oil pressure alternatively from one of the two annular spaces through the axial and radial holes. The piston prevents a leakage flow from the pressurized annular space into the non-pressurized annular space. The two axial stops prevent the piston from falling out of the axial hole. They can be achieved by inserting drilled securing stoppers or discs on both sides, or by installing the latter into one side together with a diameter decrease at the opposite end of the axial hole.

It is also advantageous that the piston can be in the form of a circular cylinder or ball. The circular cylinder form ensures maximum leakage protection based on its large sealing length. The ball form offers a safer oil pressure supply to the bottom of the pivoting vane even if it is pressurized on both sides. The ball that then sits at the center position does not block the radial hole. When the cylinder shaped piston is in its center position in this mode of operation, which then blocks the oil feed to the bottom of the pivoting vane, this is not critical since in this case no drop in pressure and thus no oil leakage flow between the pressure chambers arises and thus the hydraulic radial pressing of the pivoting vane is not absolutely required.

The work to construct the oil pressure supply to the bottom of the pivoting vane is minimized by having the radial holes extend to a distributor notch that is made in a center hole of the internal rotor or on the external perimeter of a collar seated with a press fit in this center hole. In this way, one axial hole is sufficient to supply pressurized oil to all bottoms of the rotating vanes since the pressurized oil passes through the annular notch to all radial holes and thus to all of the bottoms.

An alternative solution to loading pressurized oil onto the bottoms of the pivoting vanes includes the gap having two partial spaces that are sealed from one another and that are in constant flow connection with different annular spaces. In this solution, the bottom of the pivoting vane is indeed only loaded on one half and eccentrically with oil pressure, but this eliminates any need to control the oil feed.

It is also advantageous that the pivoting vanes have a preferably round or square stem as seen in its cross sectional profile with a diameter or a thickness that is arranged perpendicular and centered at its bottom and it slides tightly within a radial guide hole in the hub of the internal rotor. In this way, sufficient sealing of the two partial gap spaces from one another is attained in a simple manner, so that despite no control of the pressurized oil feed, no short circuit flow between the two annular spaces results. If the stem has a larger length than the guide hole, it impacts the bottom before the bottom of the pivoting vane impacts the notch base of the vane mounting notch. The length difference between the stem and guide hole determines the height of the gap in this solution.

Another variation in the pressurization of the bottom of the pivoting vane includes the gap being connected to the two annular spaces by a feed opening for each of them made in the notch base, each of which is sealed off and controlled by a valve plate lying on the notch base and loaded by the vane pressure spring. This allows the oil pressure to pass into the gap in a simple manner and without leakage. The vane pressure springs and the valve plates are made of spring steel and can have an elastomeric coating to ensure the seal of the feed openings even with non-optimal surface quality of the notch base.

A particularly simple version of the pressurized oil feed system results by having the feed openings sealed off and controlled by the flat ends of the reverse-installed vane pressure springs. Here, the valve plate can be eliminated since its function is assumed by the correspondingly designed vane pressure spring.

A design which works selectively with or without vane pressure springs is characterized by a central spacer element whose purpose is to fix another valve plate that seals off and controls other feed openings. The other valve plate outside the area of the other feed openings and the central distance element have lateral play with respect to the vane mounting notch, as does a vane pressure spring, if necessary. The solution with the central spacer element is especially easy to assemble since the other valve plate whose length corresponds to the width of the pivoting vane must only be set into the vane mounting notch prior to its assembly. The lateral play between the vane mounting notch and the central spacer element or the valve plate and, if necessary, the vane pressure spring allows unthrottled loading of the bottom of the pivoting vane with oil pressure from the feed openings. The central spacer element, in comparison to the spacer elements located at the sides of the pivoting vane, offers the advantage of greater freedom to arrange the feed openings since the space required to cover them is greater by the width of the outer spacer elements.

Another advantageous development of the invention is characterized by the central spacer element being in direct contact with the notch base and in each of the two other partial spaces another U-shaped vane pressure spring is provided opening up toward the other feed openings, the spring shoulders of which lie against the other feed opening, sealing it off and controlling it. Here, the U-shaped vane pressure spring serves as a valve plate for the feed openings together with its spring force simultaneously acting as a closing force to cover the feed openings.

Other features of the invention can be found in the claims, the following description and the drawings, in which preferred embodiments of the invention are schematically represented.

BRIEF DESCRIPTION OF THE DRAWINGS

The invention is explained in more detail based on the following embodiments. In the associated drawings are shown.

DETAILED DESCRIPTION OF THE PREFERRED EMBODIMENTS

Figure 1:
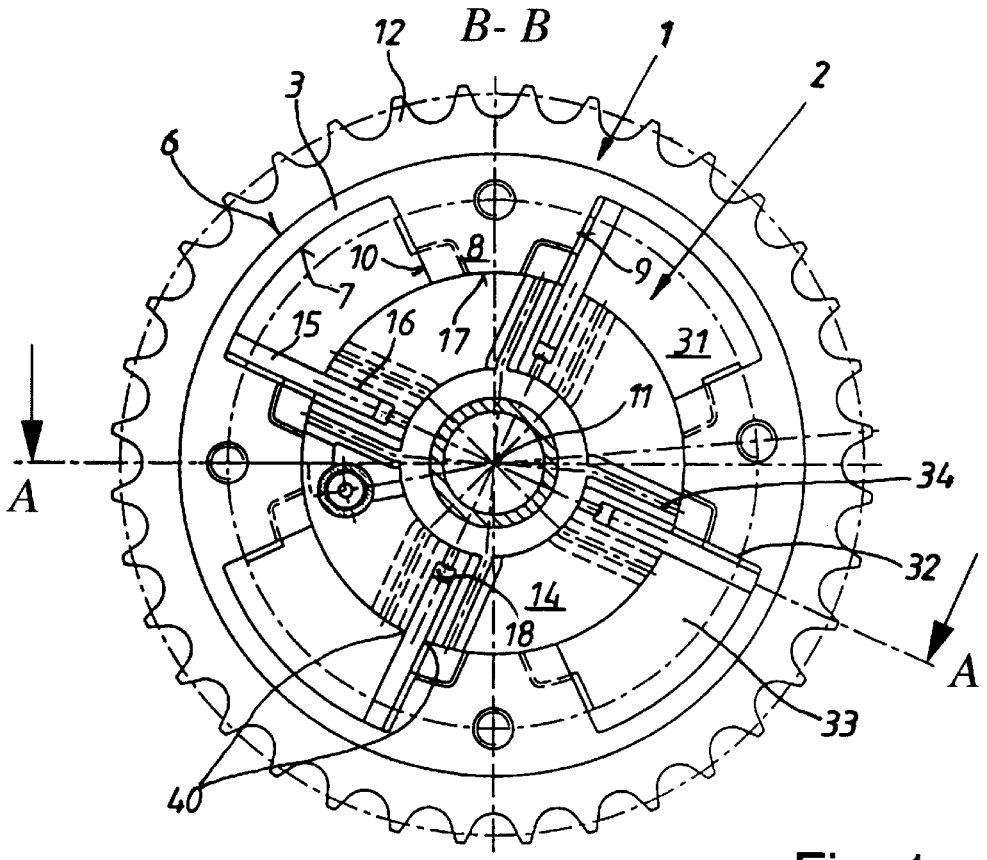
FIG. 1 a section B—B according to FIG. 2 through a vane-cell positioning device designed according to the invention.
Figure 2:
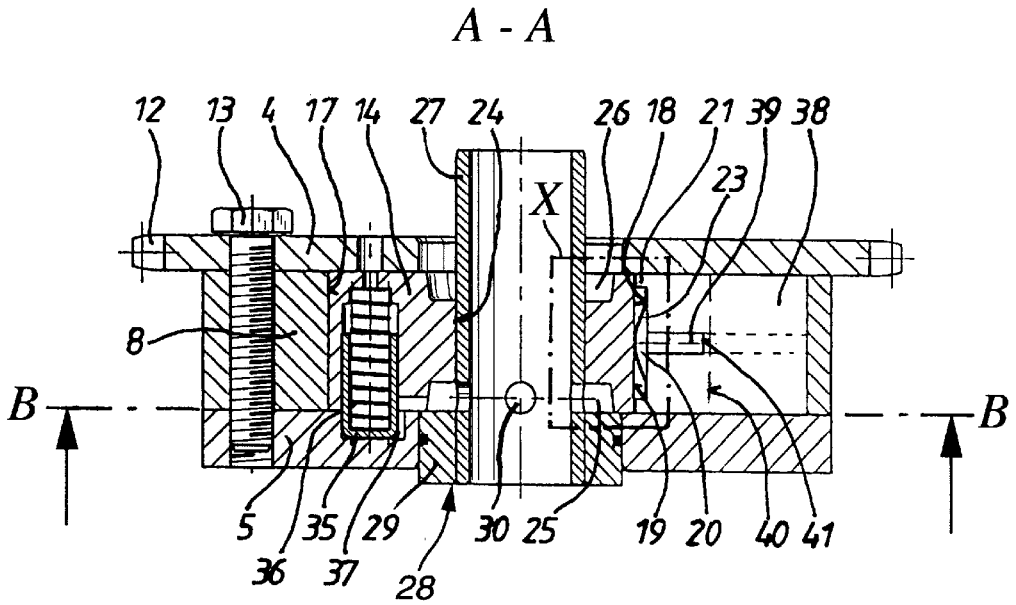
FIG. 2 an axial section A—A according to FIG. 1 through the vane-cell positioning device according to the invention with an un-controlled feed notch in the working surfaces of a pivoting vane that leads to a gap, FIG. 3 an enlarged section X from FIG. 2, but without the feed notch and with an axial and radial hole leading to the gap that is controlled by a piston based an oil pressure.

In FIGS. 1 and 2, a vane-cell positioning device is shown. This has an external rotor 1 and a concentric internal rotor 2.

The external rotor 1 is formed of a perimeter portion 3 and a first sidewall 4 as well as a second sidewall 5. The perimeter portion 3 is in the form of a circular cylinder with a cylindrical external surface 6 and a cylindrical internal surface 7. The latter surface is connected to four radially protruding, equidistant separators 8 in a one-piece construction. The first and second side faces 9, 10 of the separators, which are tilted toward one another, extend inward toward the rotation axis 11. The first sidewall 4 has a tooth arrangement 12 on its exterior perimeter for a roller chain, not shown, which connects the unit to the crankshaft that drives it, also not shown. The perimeter portion 3 is secured by four screws 13 between the first and the second sidewall 4, 5 in an oil-tight manner.

The internal rotor 2 has a cylindrical hub 14 that is connected to a camshaft, not shown, so that it rotates with the camshaft. In the hub 14, radially protruding pivoting vanes 15 are slidably mounted into vane mounting notches 16 with a tight fit. The hub 14 and the pivoting vanes 15 exhibit a sliding fit with respect to the sidewalls 4, 5. The same applies with respect to the cylindrical perimeter of the hub 14 and the interior surface 17 of the separator 8 that is sized to fit it.

Between a bottom 18 of the pivoting vane 15 and a notch base 19 of the vane mounting notch 16, there is a gap 20 that is designed as a pocket at the foot of the pivoting vane 15. Its depth is determined by lateral spacer elements 2. In the gap 20 there is a vane pressure spring 23 designed simply as a flat bending spring. This also radially presses the pivoting vane 15 against the interior cylindrical surface 7 of the perimeter portion 3 when the internal combustion engine is not running.

The hub 14 has a center hole 24 at the end of which a first and second annular space 25, 26 are located. A collar 27 is pressed into the center hole 24 and serves to feed oil separately to the annular spaces 25, 26. A thrust ring 29 is pressed onto the end 28 of the collar 27 furthest from the camshaft and seals the first annular space 25 to the outside, and the external rotor 1 is mounted on it. The pressurized oil is fed to the first annular space 25 from the inside of the collar 27 through radial oil feed holes 30; the pressurized oil feed to the second annular space 26 is not shown, nor is its exterior seals.

In the external rotor 1, there are working spaces 31 that are bounded by the sidewalls 4, 5, the cylindrical interior surface 7 of the perimeter portion 3 and the separators 8, and are sealed off by the hub 14 of the interior rotor 2. The pivoting vanes 15 divide the work spaces 31 into two pressure chambers each 32, 33, which are charged with pressurized oil from the annular spaces 25, 26 through oil supply holes 34. When only one side is charged, the internal rotor 2 rotates with respect to the exterior rotor 1, whereupon an angular adjustment of the camshaft with respect to the crankshaft is effected. This results in a change of the control timing. If the two pressure chambers 32, 33 are simultaneously charged, the current position of the pivoting vanes 15 and thus the control timing of the camshaft are fixed.

When the oil pressure drops below a certain level, a fixing pin 35 is engaged into a pocket opening 37 in a second sidewall 5 by means of a compression spring 36. This locks the external and internal rotors 1, 2 together, whereupon high frequency clicking noise caused by the alternating moments of the camshaft when the internal combustion engine decelerates and accelerates are prevented.

The functional reliability and the positioning speed as well as the efficiency of a vane-cell positioning device depend very much on the oil pressure seal between the individual pressure chambers 32. 33. It is especially important here to prevent the pivoting vanes 15 from lifting off the cylindrical interior surface 7 of the external rotor 1 due to oil pressure. This is accomplished according to the invention by subjecting the bottoms 18 of the pivoting vanes 15 to oil pressure when the internal combustion engine is running. In so doing, the oil pressure is removed from the pressure chambers 32, 33 or the annular spaces 25, 26. This provides constant equilibrium between the oil pressure present at the radial seal edge and at the bottom 18 of the pivoting vanes 15. Since the pressure first acts on the bottoms 18 as it comes from the annular spaces 25, 26, and thus radially seats the pivoting vanes 15 before the pressure chambers 33, 34 are pressurized, it is possible in some circumstances to entirely eliminate the vane pressure springs 23.

In the solution according to FIG. 2, radial center feed notches 39 are provided in the working surfaces 38 of the pivoting vanes 15. Pressurized oil flows through these from the pressure chambers 32, 33 into the gap 20 and thus onto the bottom 18 of the pivoting vanes 15. Since pressurized oil feed is required from both pressure chambers 32, 33, thus requiring a feed notch 39 at both working surfaces 38 of the pivoting vanes 15, these also cause a certain degree of short circuiting at the same time between the pressure chambers 32, 33. The feed notches 39 are designed so that their throttling effect only slightly delays the pressure buildup in the gap 20, but the dual throttling effect between the pressure chambers 32, 33 keeps the short circuit flow negligible. The throttling effect is determined by appropriately selecting the overhang between the top edges 40 of the vane mounting notch 16 and the end 41 of the feed notch 39. In a feed notch 39 that extends across the entire length of the pivoting vane 15 (in FIG. 2 shown by dashed lines), the width and/or depth of the feed notch 39 must be appropriately designed.

Other solutions to the oil pressure loading of the bottoms 18 of the pivoting vanes 15 are shown in FIGS. 3 through 8, which show an enlarged section X from FIG. 2 in modified forms, respectively.

Figure 3:
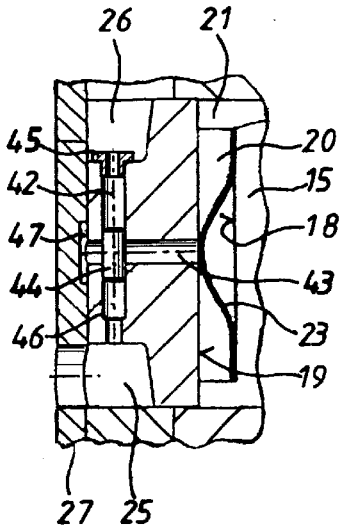

In the solution according to FIG. 3, the two annular spaces 25, 26 are connected through an axial hole 42. This is located in the plane of one of the pivoting vanes 15 and is parallel to the bottom 18. It crosses a radial hole 43 extending from the middle of each notch base 19. In the axial hole 42, there is an axially shifting and sealed driven piston 44 that controls the radial hole and whose stroke is bounded on both sides by axial stops. The oil pressure flows alternatively from one of the two annular spaces 25, 26 through the axial and radial holes 42, 43 into the gap 20 and loads the bottom 18 of the pivoting vane 15. The piston 44 prevents any short-circuit flow from the respective pressure loaded space into the pressure relieved annular space 25, 26. A drilled securing stopper 45 and a ledge 46 serve as the stops at opposite ends of the axial hole 42. The radial holes 43 lead to a distribution notch 47 in the exterior perimeter of the collar 27, through which the bottoms 18 of the other pivoting vanes 15 are provided with pressurized oil. The vane pressure springs 23 inserted into the gaps 20 prevent the pivoting vanes 15 from dropping down when oil pressure is not present.

Figure 4:
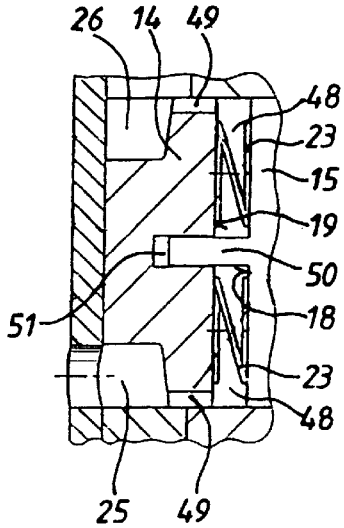
FIG. 4 the enlarged section X of FIG. 2, but without the feed notch and with a gap that is divided into oil-tight sections, wherein the partial spaces have a separate and un-controlled pressurized oil feed.

In the solution according to FIG. 4, the space beneath the pivoting vanes 15 is divided into two partial spaces 48 that are sealed from one another and are in constant flow connection with different annular spaces 25, 26 through side channels 49. The subdividing occurs using a stem 50 whose diameter is the same as the thickness of the pivoting vane 15 and which is arranged perpendicular to and in the center of its bottom 18. It has a sliding fit in a radial guide hole 51 of the hub 14. It also serves as a spacer element since its length is larger than the depth of the guide hole 51 and it thus impacts the hole's base before the bottom 18 touches the notch base 19. Indeed, in this solution the bottom 18 of the pivoting vane 15 is loaded only on one half eccentrically with oil pressure, but there is no need to control the oil feed. For the partial spaces 48, separate vane pressure springs 23 are used that also prevent the pivoting vanes 15 from dropping down when there is no oil pressure.

Figure 5:
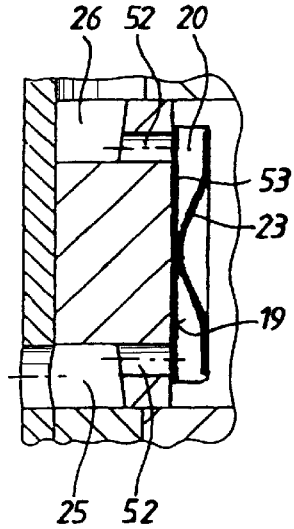
FIG. 5 the enlarged section X of FIG. 2, but without the feed notch and with feed openings that are oil controlled by a valve plate based on oil pressure, wherein the valve plate is centrally loaded by a vane pressure spring.

In the solution according to FIG. 5, the gap 20 is connected to each of the two annular spaces 25, 26 through a respective feed opening 52 in the notch base 19. These openings are sealed off and controlled by a valve plate 53 lying on the notch base 19. The valve plate 53 is held against the notch base 19 by the vane pressure spring 23. In this solution, the pressurized oil passes in a simple manner and without leakage into the gap 20.

Figure 6:
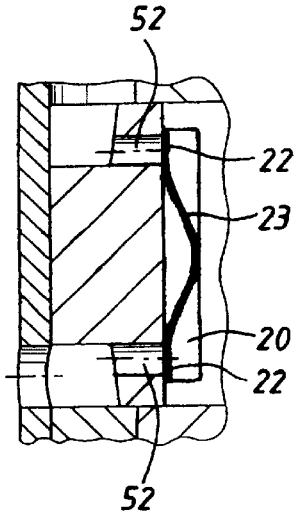
FIG. 6 the enlarged section X of FIG. 2, but without the valve plate and with reverse installed vane pressure springs whose flat ends cover and control the feed openings.

This also applies to the solution according to FIG. 6, in which the feed openings 52 are sealed off and controlled through the flat ends 22 of the vane pressure spring 23 inserted in a reverse [of the latter]. In this way, the valve plate 53 is not necessary since its function is assumed by the appropriately designed and arranged vane pressure spring 23.

Figure 7:
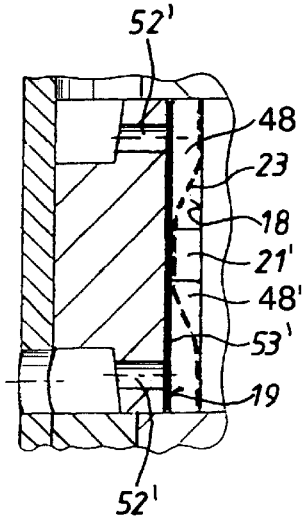
FIG. 7 the enlarged section X of FIG. 2, but without the feed notch and with other feed openings that are sealed and controlled by oil pressure by another valve plate, wherein instead of the two lateral spacer elements, one central spacer element is provided with a smaller thickness than that of the pivoting vane.

In FIG. 7, a solution is displayed in which a centrally arranged spacer element 21' is provided that divides the space beneath the pivoting vane 15 into two other partial spaces 48' and that serves to fix another valve plate 53', which seals off and controlled the other feed openings 52'. The centrally arranged distance element 21' and the other valve plate 53' have lateral play with respect to the vane mounting notch 16 on the outside of the area of the other feed openings 52'. The same applies for the vane pressure springs 23, 23' and the valve plates 53, 53' of FIGS. 5 through 8. In this way, the oil pressure passes from the feed openings 52, 52' un-throttled into the gap 20 and into the other partial spaces 48' and to the bottom 18. The solution of FIG. 7 is especially easy to assemble since the valve plate 53', whose length is equal to that of the notch base 19 can only be placed in one position on it.

Figure 8:
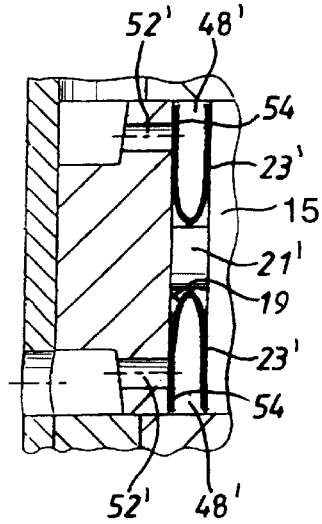
FIG. 8 the enlarged section X of FIG. 2, but with two U-shaped vane pressure springs whose shoulders facing away from the vane seal and control the other feed openings by oil pressure.

In the solution according to FIG. 8, the centrally arranged spacer element 21' is in direct contact with the notch base 19. In each of the two other partial spaces 48', there is another U-shaped vane pressure spring 23' opening up toward the other feed openings 52'. The shoulders 54 of the springs lie against the other feed opening 52', sealing it off and controlled it. Thus, the U-shaped vane pressure spring 23' is also a closing element for the other feed openings 52'.

In the solutions of FIGS. 5 through 8, the vane pressure springs 23, 23' and the valve plates 53, 53' are formed of spring steel that purposefully has an elastomeric coating in order to ensure a sealing off of the feed openings 52, 52' even at non-optimal surface quality of the notch base 19.

The solutions according to the invention can be applied even to sealing strips in a pivoting vane positioning device. Even here, the danger exists of the sealing strips lifting off of the sealing surfaces of the external and internal rotor. Loading the bottoms of the sealing strips with pressurized oil can likewise counteract this danger.

The solutions according to the invention are not limited to angular positioning device, but can also be used for hydraulic or pneumatic pivoting motors or pivoting pumps, for example vane pumps or similar device.

REFERENCE LIST

1 External rotor
2 Internal rotor
3 Perimeter portion
4 First sidewall
5 Second sidewall
6 Cylindrical external surface
7 Cylindrical internal surface
8 Separator
9 First side face
10 Second side face
11 Rotating axis
12 Tooth arrangement
13 Screws
14 Hub
15 Pivoting vane
16 Vane mounting notch
17 Interior surface
18 Bottom
19 Notch base
20 Gap
21 Spacer element
21' Spacer element
22 Flat end
23 Vane pressure spring
23' Other vane pressure spring
24 Center hole
25 First annular space
26 Second annular space
27 Collar
28 End furthest from camshaft
29 Thrust ring
30 Radial oil feed hole
31 Working space
32 First pressure chamber
33 Second pressure chamber
34 Oil supply hole
35 Fixing pin
36 Compression spring
37 Pocket opening
38 Working surface
39 Feed notch
40 Top edge
41 End of the feed notch
42 Axial hole
43 Radial hole
44 Piston
45 Drilled securing stopper
46 Ledge
47 Distribution notch
48 Partial space
48' Other partial space
49 Side channel
50 Stem
51 Guide hole
52 Feed opening
52' Other feed opening
53 Valve plate
53' Other valve plate
54 Spring shoulder

What is claimed is:

1. A vane-cell positioning device to adjust a rotary angle position of a camshaft with respect to a crankshaft of an internal combustion engine, comprising:

an external rotor (1) driven off of the crankshaft and an internal rotor (2) coaxial to the external rotor that is connected to and turns with the camshaft and has a common rotation axis (11) with the external rotor (1);

inside the external rotor (1) is at least one hydraulic working space (31) that is divided into a first and second pressure chamber (32, 33) by a pivoting vane (15) of the internal rotor (2);

the pressure chambers (32, 33) are in fluid communication with two annular spaces (25, 26) in the internal rotor and are supplied with pressurized oil by the pressure chambers in alternating fashion or at the same time;

the internal rotor (2) has at least one vane mounting notch (16) for the pivoting vane (15);

between a notch base (19) of the vane mounting notch (16) and a bottom (18) of the pivoting vane (15) is a gap (20) for a vane pressure spring (23), the bottom (18) of the pivoting vane (15) is loaded with pressurized oil when the internal combustion engine is running and the bottom (18) of the pivoting vane (15) is in fluid communication with at least one of the pressure chambers (32, 33) and the annular spaces (25, 26) located in the internal rotor (2);

the pivoting vane (15) includes two working surfaces (38) which have radial and centered feed notches (39).

2. A device according to claim 1, characterized in that the feed notches (39) extend from the bottom (18) to at least an area of a top edge (40) of the at least one vane mounting notch (16) when the pivoting vane (15) is installed.

3. A device according to claim 1, characterized in that in a hub (14) of the internal rotor (2) under the vane mounting notch (16) there is an axial hole (42) that connects the two annular spaces (25, 26) together and intersects radial holes (43) that run through a middle of each notch base (19).

4. A device according to claim 3, characterized in that an axially shifting piston (44) sealingly slides in the axial holes (42) that controls the radial holes (43) and whose stroke is bounded by axial stops on both sides.

5. A device according to claim 4, characterized in that the piston (44) has a cylindrical or ball shape.

6. A device according to claim 3, characterized in that the radial holes (43) extend up to a distribution notch (47) that is made in a center hole (24) of the internal rotor (2) or on an external perimeter of a collar (27) sitting inside the center hole (24).

7. A device according to claim 1, characterized in that the gap (20) has two partial spaces sealed off from one another, that are in continuous flow connection with different annular spaces (25, 26).

8. A device according to claim 1, characterized in that the pivoting vane (15) has a stem (50) with a diameter equal to its thickness that is positioned perpendicular to and at a center of the bottom (18) and slides inside a radial guide hole (51) of the hub (14) of the internal rotor (2).

9. A device according to claim 8, characterized in that the stem (50) has a larger length than the guide hole (51).

10. A device according to claim 1, characterized in that the gap (20) is connected to each of the two annular spaces (25, 26) through its respective feed opening (52) made in the notch base (19), said openings being sealed off and controlled by a valve plate (53) lying on the notch base (19) and loaded by the vane pressure spring (23).

11. A device according to claim 10, characterized in that the feed openings (52) are sealed off and controlled by flat ends (22) of the reverse installed vane pressure spring (23).

12. A device according to claim 1, characterized in that a central spacer element (21') is provided that serves to fix a valve plate (53') that seals off and controls feed openings (52') between the gap (20) and each of the two annular spaces (25, 26), wherein the valve plate (53') outside an area of the other feed openings (52') as well as the central spacer element (21') and, if necessary, a vane pressure spring (23) have lateral play with respect to the vane mounting notch (16).

13. A device according to claim 12, characterized in that the central spacer element (21') is in direct contact with the notch base (19) and in each of two partial spaces (48') there is a U-shaped vane pressure spring (23') facing out toward the feed openings (52'), whose spring shoulder (54) sitting against the other feed opening (52') seals off the opening and controls it.

* * * * *